United States Patent [19]

Wagner

[11] Patent Number: 4,746,057

[45] Date of Patent: May 24, 1988

[54] FINGER-STABILIZED EATING PLATE

[76] Inventor: Otto W. Wagner, 2927 E. Burnside St., Portland, Oreg. 97214

[21] Appl. No.: 843,635

[22] Filed: Mar. 25, 1986

[51] Int. Cl.[4] ..... B65D 5/00

[52] U.S. Cl. ..... 229/1.5 H; 294/25; 294/144; 220/94 A

[58] Field of Search ..... 229/2.5 R, 1.5 H, 52 B, 229/DIG. 6; 206/1.7, 1.8, 1.9; 294/25, 26.5, 144, 172; 220/94 R, 94 A

[56] References Cited

U.S. PATENT DOCUMENTS

| | | | |
|---|---|---|---|
| 1,953,933 | 4/1934 | Gundelach | 294/172 |
| 2,593,138 | 4/1952 | Gombarts . | |
| 2,647,678 | 8/1953 | Olson | 229/1.5 H |
| 2,669,379 | 2/1954 | Olson . | |
| 2,723,068 | 11/1955 | Ettwein | 294/144 |
| 2,988,967 | 6/1961 | Dudnick et al. | 229/1.5 H X |
| 3,098,654 | 7/1963 | Larsen | 294/25 X |
| 3,179,286 | 4/1965 | Morceau . | |
| 3,198,377 | 8/1965 | Buckley | 220/94 A |
| 3,381,849 | 5/1968 | Karlsson . | |
| 3,456,283 | 7/1969 | Glenn . | |
| 3,662,946 | 5/1972 | Marinissen et al. | 229/1.5 H X |
| 3,955,672 | 5/1976 | Brundage . | |

*Primary Examiner*—Steven M. Pollard
*Attorney, Agent, or Firm*—Eugene D. Farley

[57] ABSTRACT

A finger-stabilized eating plate such as a "paper" plate designed for use at picnics and other informal meals comprises a plate body and, on the underside of the plate centrally thereof, finger gripping means located and dimensioned for gripping between the fingers of the plate user, thereby stabilizing the plate as food is placed upon it and eaten from it.

11 Claims, 1 Drawing Sheet

FINGER-STABILIZED EATING PLATE

BACKGROUND AND GENERAL STATEMENT OF THE INVENTION

This invention relates to plates and like utensils used for the display and eating of foods, termed herein "eating" plates. It is described with particular reference to the class of plates commonly designated as "paper plates" and made of cardboard or paper board, although no limitation thereby is intended since it is applicable equally to plates made from such materials as molded plastic and thin metal sheets, for example sheet aluminum and sheet aluminum alloys.

As is well known, paper plates have little dimensional rigidity and stability. As a result, when they are used at picnics, buffets, on board pleasure boats, and in similar situations it is difficult to load them with food, transport them loaded to the dining location, and hold them steadily while eating. These endeavors have been made especially difficult by the tendency of the non-rigid plates to fold, bend or collapse during use, particularly when they are inadequately supported and moved from place to place.

It is the principal object of the present invention to provide a plate of the class described which is stabilized against falling and collapse and which accordingly can be used, even in difficult situations, with comfort, safety and efficiency.

It is another object of the invention to provide a paper plate which per se has sufficient stability for efficient use without requiring the supplemental use of a rigid back-up plate.

It is a further object of the invention to provide a stabilized paper plate which can be manufactured by the methods commonly used in the industry, without extensive modification and without incurring excessive manufacturing costs.

It is another object of the invention to provide a paper plate which nests in the hand and is subject to full hand control of balance and stability during its use.

Still another object of the invention is the provision of a paper plate which is stackable for compact storage, but which is quickly and easily adjusted to its use position.

The foregoing and other objects of the invention are achieved by the provision of a paper plate which, broadly considered, comprises a plate body and, on the underside of the plate body, centrally thereof, finger gripping means located and dimensioned for gripping between the fingers of the plate user. In use, the plate thus nests in the hand of the user and is subject to his full hand control of balance and stability.

THE DRAWINGS

DESCRIPTION OF PREFERRED EMBODIMENTS OF THE INVENTION

Figure 1:
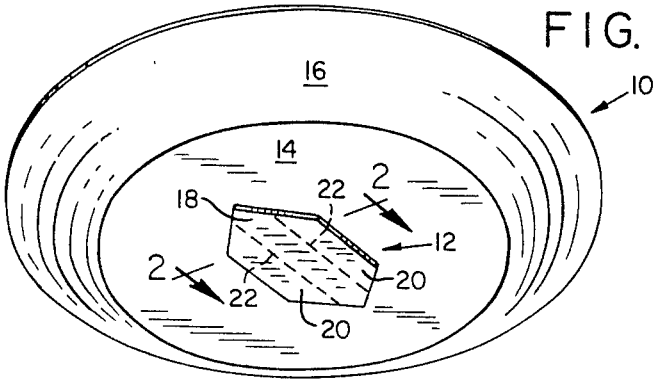
FIG. 1 is a bottom perspective view of the plate of the invention in a first embodiment.
Figure 2:
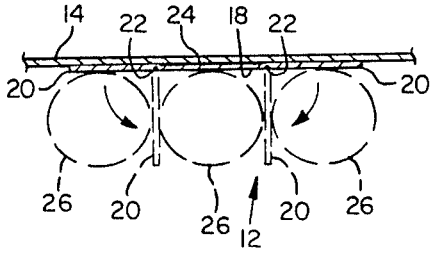
FIG. 2 is a fragmentary sectional view taken along line 2—2 of FIG. 1.

In the embodiment of FIGS. 1 and 2, the plate of the invention comprises a plate body, indicated generally at 10, and associated finger-gripping means, indicated generally at 12.

In the illustrated form of the invention, the plate body 10 comprises a conventional paper (cardboard) plate having a bottom 14 and a dished, fluted rim 16. However, as noted above, the plate body may be made of materials other than paper, such as molded plastic or sheet aluminum.

The finger-gripping means 12 comprises a flat strip of cardboard divided into a base, or anchoring, segment 18 and a pair of side, or tab segments 20.

Tab segments 20 are secured to base segment 18 by means of fold lines 22, which serve as integral hinges.

Base segment 18 is glued to the underside of the plate bottom by means of a glue line 24. It is glued in a location calculated to place the finger grip centrally of the plate bottom.

Tab segments 20 are dimensioned and contoured for reception between fingers 26, when the tab segments are extended to the dashed line, use position of FIG. 2. Lateral pressure exerted by the fingers thus can be used to grip and stabilize the plate.

Figure 3:
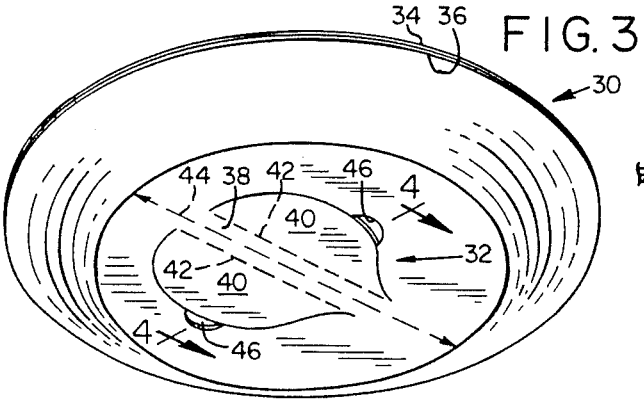
FIG. 3 is a bottom perspective view of the plate of the invention in a second embodiment and in its storage condition.
Figure 4:
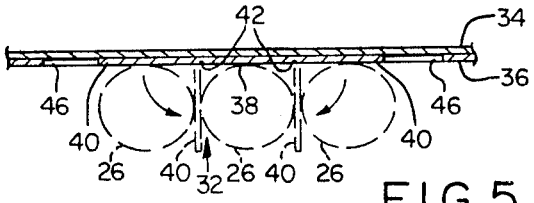
FIG. 4 is a fragmentary sectional view taken along line 4—4 of FIG. 3.
Figure 5:
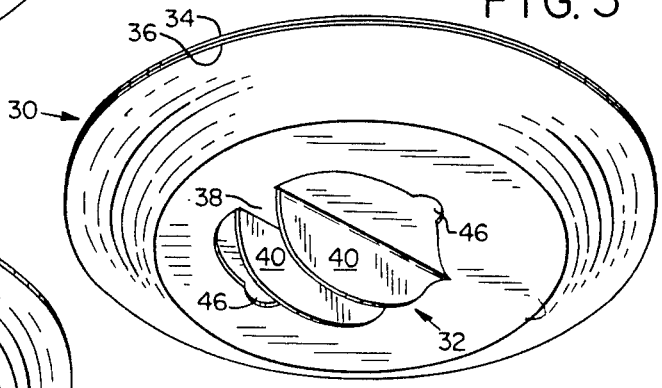
FIG. 5 is a bottom perspective view of the plate of FIG. 3 in its use condition.

In the embodiment of FIGS. 3, 4 and 5 the plate of the invention comprises a laminar plate body, indicated generally at 30, and associated finger-gripping means indicated generally at 32.

The laminar plate body comprises an upper lamina 34 adherently united to a lower lamina 36.

Upper lamina 34 may comprise a conventional paper plate.

Lower lamina 36 comprises a conventional paper plate die cut to provide the finger grip 32.

As in the case of the embodiment of FIGS. 1 and 2, the finger grip comprises a base segment 38 and a pair of tab or grip segments 40.

Tab segments 40 are secured to base segment 38 by means of fold lines 42, which serve as integral hinges.

Base segment 38, and hence the entire finger-grip assembly 32, is located centrally of the bottom of lower lamina 36, but offset slightly from the geometric center thereof. Preferably it is offset by a radial distance equal to from about 5% to about 20% of the plate diameter, as indicated by dashed line 44 of FIG. 3. As a result, when the plate is in use, the portion above the grip will nest securely in the palm of the hand, stabilizing the plate, affording efficient manual control, and giving substantial support to a heavy object such as a beverage glass which may be superimposed directly above.

To facilitate bending tabs 40 outwardly when adjusting the grip assembly from its storage, stacked condition of FIG. 3 to its use condition of FIG. 5, there also are provided finger access openings 46 adjacent the margins of the tabs.

Figure 6:
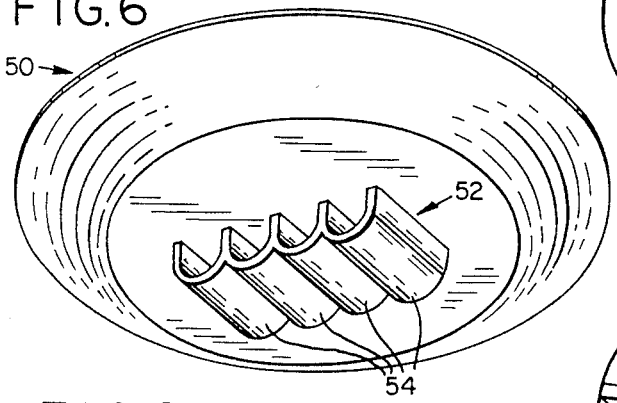
FIG. 6 is a bottom perspective view of the plate of the invention in a third embodiment.

The plate of the embodiment of FIG. 6 illustrates the application to the invention of an alternate type of finger grip means, i.e. of a tubular type of finger grip means.

In this embodiment, the plate is indicated generally by the numeral 50, and the finger grip by the numeral 52. Preferably both are formed from an integral piece of molded plastic.

Plate 50 may be conventional in contour and size.

The finger grip 52 comprises a plurality, preferably three or four, of laterally adjacent, centrally disposed tubular elements which are open on both ends. By virtue of the molding process by which they are formed, the tubes are defined structurally in part by the undersurface of the plate.

Each tube has an internal diameter predetermined to receive a selected finger of the plate user. Accordingly the tubes collectively provide means for holding and stabilizing the plate and its contents.

Figure 7:
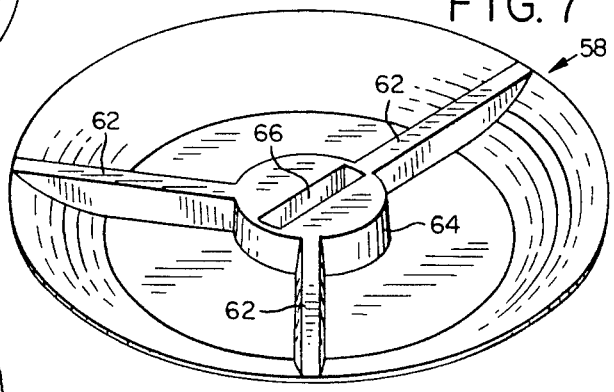
FIG. 7 is a top perspective view of the plate of the invention in a fourth embodiment.
Figure 8:
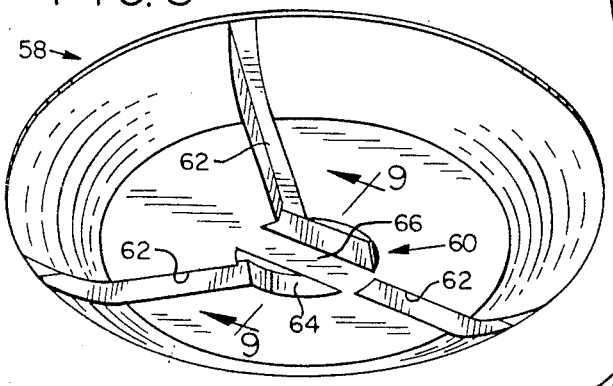
FIG. 8 is a bottom perspective view of the plate of FIG. 7.
Figure 9:
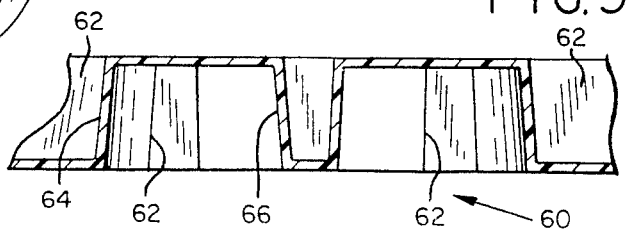
FIG. 9 is a fragmentary, sectional view taken along line 9—9 of FIG. 8.

Like the embodiment of FIG. 6, the plate of the embodiment of FIGS. 7, 8 and 9 preferably is made of an integral piece of molded plastic. It comprises a plate body 58 and a finger grip 60.

Plate body 58 may be conventional in size and contour. However, it preferably is characterized by the presence of a plurality of radially spaced ribs 62 which divide the upper surface of the plate into compartments for the reception of various food varieties.

The undersurface of the plate has a central recess defined by side walls 64 upstanding above the upper surface of the plate and providing an inner terminus for ribs 62. A finger tab 66 spans or bridges the recess. It is located and dimensioned for gripping between the fingers of the user, thus making possible stabilizing the plate in the manner described above.

In use, the plates of all of the hereindescribed embodiments provide on their undersides finger-gripping means which may be used to support and steady the plate as it is being used. In the embodiment of FIGS. 1 and 2, tabs 20 serve this function. In the embodiment of FIGS. 3, 4 and 5 it is tabs 40; in FIG. 6 it is tubes 54; and in FIGS. 7, 8 and 9 it is bridge 66. All share the common advantage of providing a "paper" plate which will support a substantial load, subject to efficient manual control against folding, bending, and collapsing.

Having thus described my invention in preferred embodiments,

I claim:

1. A finger-stabilized eating plate comprising:

(a) a plate body, and (b) on the underside of the plate body, centrally thereof, finger-gripping means located and dimensioned for gripping between the fingers of the plate user by laterally exerted finger pressure, the finger gripping means terminating at one end inwardly of the outer perimeter of the underside of the plate body bottom sufficiently to nest the plate body bottom in the palm of the hand of the plate user when the fingers of the plate user grip the finger-gripping means, said finger gripping means being sized such that said finger gripping means terminate adjacent the back of the fingers when the plate is held in the palm of the hand with the finger gripping means gripped between the fingers.

2. A finger-stabilized eating plate comprising:

(a) a plate body, and (b) on the underside of the plate body at least one centrally located, outwardly and radially extending tab located and dimensioned for gripping between the fingers of the user by laterally exerted finger pressure, the tab terminating at one end inwardly of the outer perimeter of the underside of the plate body sufficiently to nest the plate body bottom in the palm of the hand of the plate user when the fingers of the plate user grip the tab, said tab being sized such that said tab terminates adjacent the back of the fingers when the plate is held in the palm of the hand with the tab gripped between the fingers.

3. The plate of claim 2 wherein there are at least two latterally-spaced, substantially parallel tabs on the underside of the plate body for gripping betweeen the fingers of the hand of the plate user.

4. The plate of claim 2 wherein the tab is offset from the center of the plate by a radial distance equal to from about 5% to about 20% of the plate diameter.

5. The plate of claim 2 wherein the end edges of the tab are inwardly sloping in contour.

6. The plate of claim 2 wherein the end edges of the tab are convexly arcuate in contour.

7. The plate of claim 2 wherein the plate body is laminar, comprising an upper lamina and a lower lamina, and wherein the tab is cut inwardly of the perimeter of and hinged into the structure of the lower lamina for folding outwardly into the operative position.

8. The plate of claim 2 wherein the tab comprises a tube having an internal diameter predetermined to receive a selected finger of the plate user.

9. The plate of claim 2 wherein there are a plurality of laterally adjacent tabs each comprising a tube defined structurally in part by the undersurface of the plate, and each having an internal diameter predetermined to receive a selected finger of the plate user.

10. The plate of claim 1 wherein the undersurface of the plate has a central recess defined by sidewalls upstanding above the upper surface of the plate and including a tab spanning the recess and located and dimensioned for gripping between the fingers of the user.

11. The plate of claim 10, including a plurality of radially spaced ribs on the upper surface of the plate, the ribs extending radially outwardly from the sidewalls and dividing the upper surface of the plate into compartments for receiving food varieties of selected categories.

* * * * *